US011406234B1

(12) United States Patent
Cadogan

(10) Patent No.: US 11,406,234 B1
(45) Date of Patent: Aug. 9, 2022

(54) TOILET BOWL SCREEN APPARATUS

(71) Applicant: Sven Cadogan, Conyers, GA (US)

(72) Inventor: Sven Cadogan, Conyers, GA (US)

( * ) Notice: Subject to any disclaimer, the term of this patent is extended or adjusted under 35 U.S.C. 154(b) by 0 days.

(21) Appl. No.: 17/183,979

(22) Filed: Feb. 24, 2021

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/300
See application file for complete search history.

(56) References Cited

U.S. PATENT DOCUMENTS 2,974,324 A 3/1961 Lundelius
5,930,847 A 8/1999 Hall
6,721,965 B1 4/2004 Alston
6,804,838 B2 * 10/2004 Lacus ..... E03D 9/00 4/255.01
7,096,516 B1 8/2006 Moore, Jr.
2003/0024038 A1 2/2003 Cross
2003/0035302 A1 * 2/2003 Friedman ..... A47K 13/24 363/1
2006/0053541 A1 3/2006 Howard
2007/0039089 A1 * 2/2007 Worrel ..... E03D 9/00 4/300.3

* cited by examiner

*Primary Examiner* — Huyen D Le

(57) ABSTRACT

A toilet bowl screen apparatus for preventing animals from exiting a toilet bowl includes a screen edge conforming to the shape of a rim of a toilet bowl. A screen body is coupled to the screen edge. The screen body is mesh and has a plurality of gaps with each gap small enough to prevent a snake or other animal from crawling therethrough. Each of a pair of rear clips is coupled to the screen body to selectively engage a rim rear portion of the rim of the toilet bowl. A front clip has a front hook portion pivotably coupled to the screen edge and a handle portion coupled to the front hook portion. The handle portion allows a user to move the front hook portion with the front hook portion selectively engaging or disengaging a rim front portion of the rim of the toilet bowl.

10 Claims, 4 Drawing Sheets

TOILET BOWL SCREEN APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toilet bowl screen devices and more particularly pertains to a new toilet bowl screen device for preventing pest animals from exiting a toilet bowl. The present invention covers the bowl with a screen that does not need to be submerged and can be easily engaged and disengaged from the toilet.

(2) Description of Related Art Including Information Disclosed Under 37 CFR 1.97 and 1.98

The prior art relates to toilet bowl screen devices. Known devices typically are submerged within the water and thus inconvenient to remove as desired. Other known devices that are not submerged are solid and thus do not allow the user to see what will be within the bowl before removal.

BRIEF SUMMARY OF THE INVENTION

An embodiment of the disclosure meets the needs presented above by generally comprising a screen edge configured to conform to the shape of a rim of a toilet bowl and larger than an inner perimeter of the rim of the toilet bowl. A screen body is coupled to the screen edge. The screen body continuously covers within the screen edge. The screen body is mesh and has a plurality of gaps with each gap configured to be small enough to prevent a snake or other animal from crawling therethrough. The screen body has a body top side and a body bottom side. A pair of rear clips is coupled to the screen body. Each of the rear clips is coupled to the body bottom side and is configured to selectively engage a rim rear portion of the rim of the toilet bowl. A front clip is coupled to the screen edge. The front clip has a front hook portion pivotably coupled to the screen edge and resting below the body bottom side and a handle portion coupled to the front hook portion and extending above the body top side. The handle portion allows a user to move the front hook portion with the front hook portion configured to selectively engage or disengage a rim front portion of the rim of the toilet bowl.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
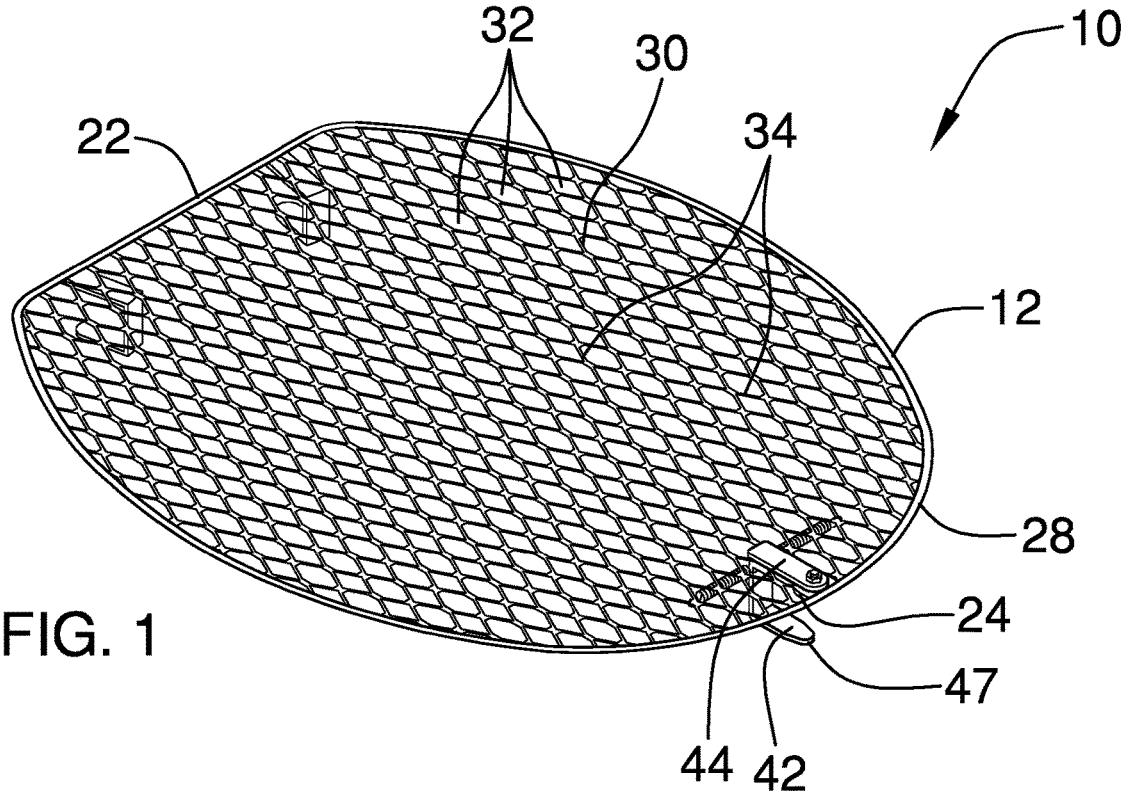
FIG. 1 is an isometric view of a toilet bowl screen apparatus according to an embodiment of the disclosure.
Figure 2:
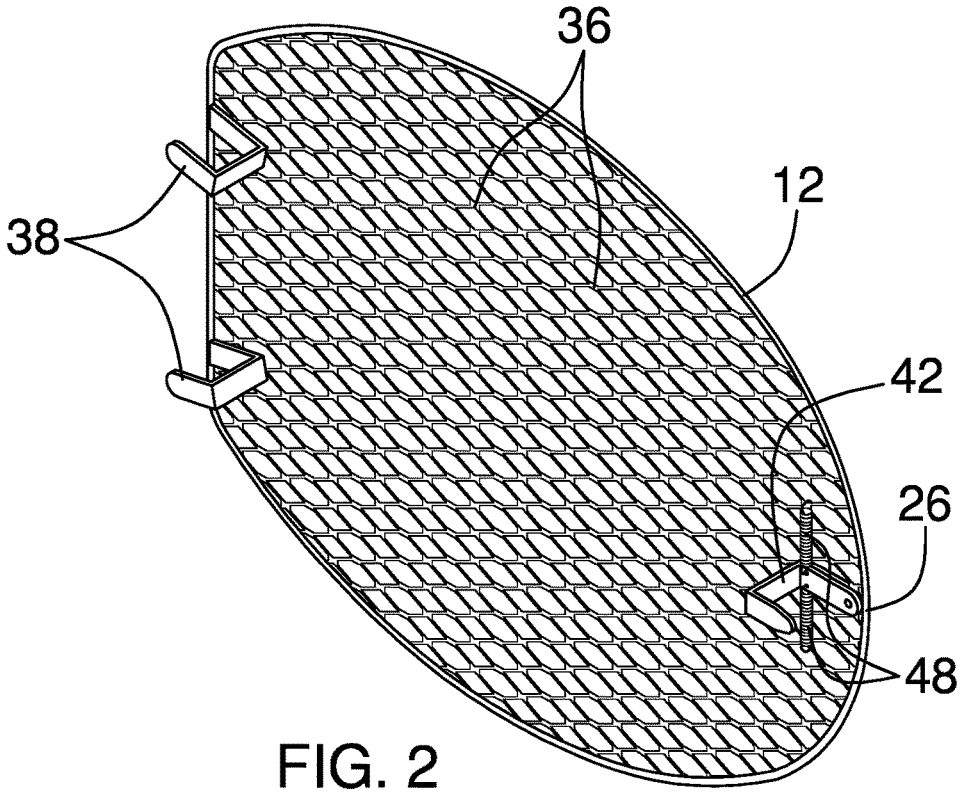
FIG. 2 is an isometric view of an embodiment of the disclosure.
Figure 3:
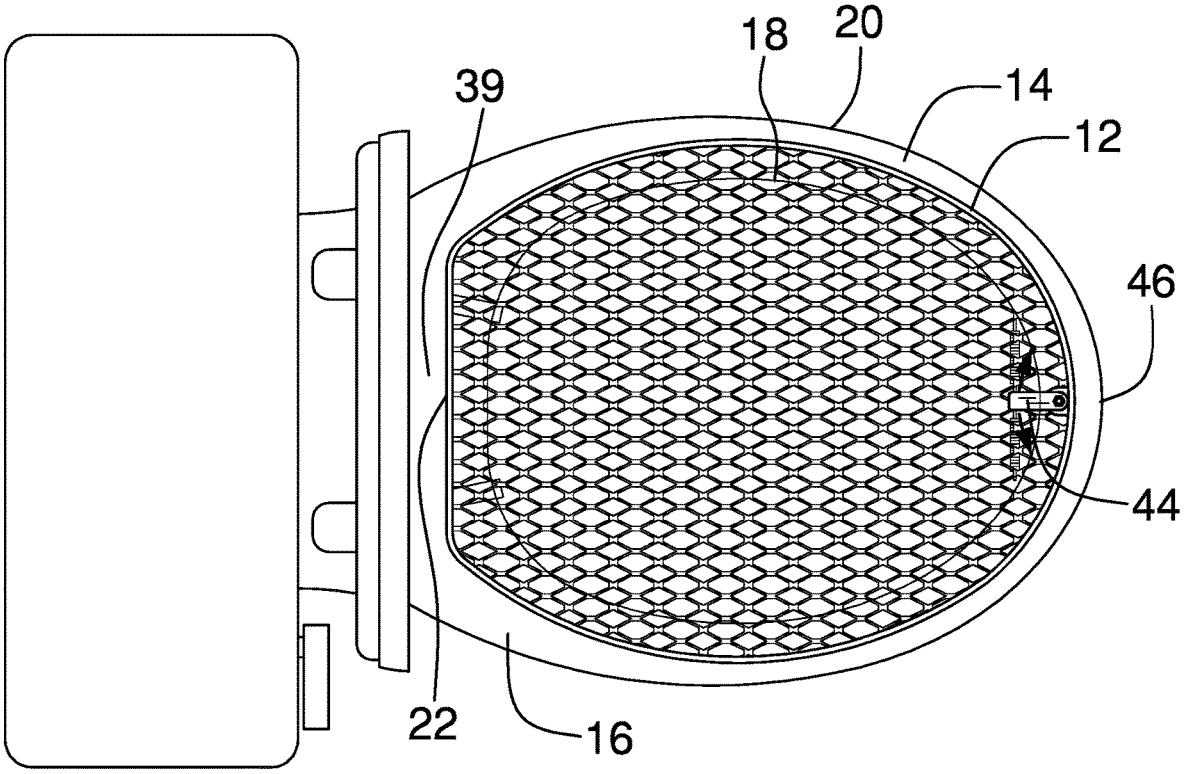
FIG. 3 is a top plan in-use view of an embodiment of the disclosure.
Figure 4:
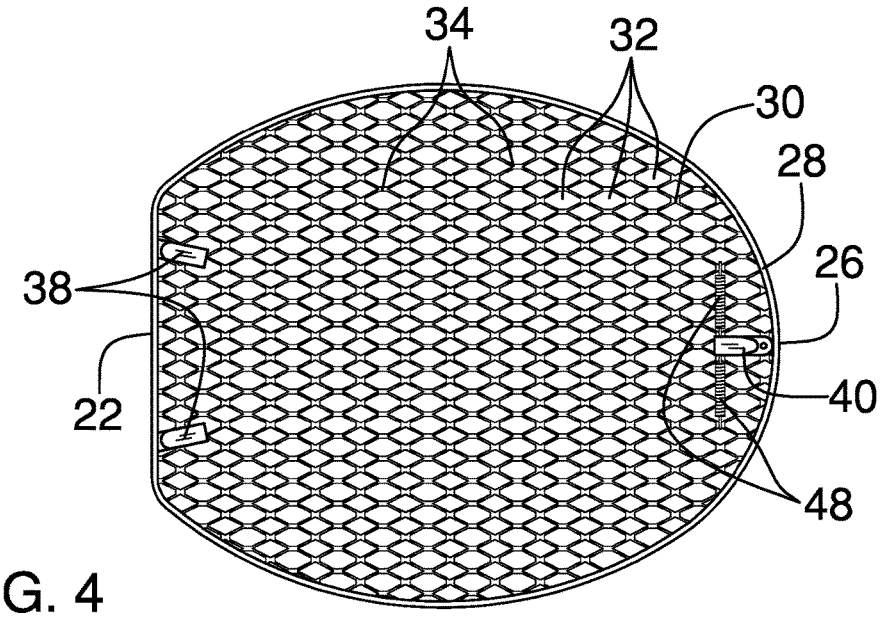
FIG. 4 is a bottom plan view of an embodiment of the disclosure.
Figure 5:
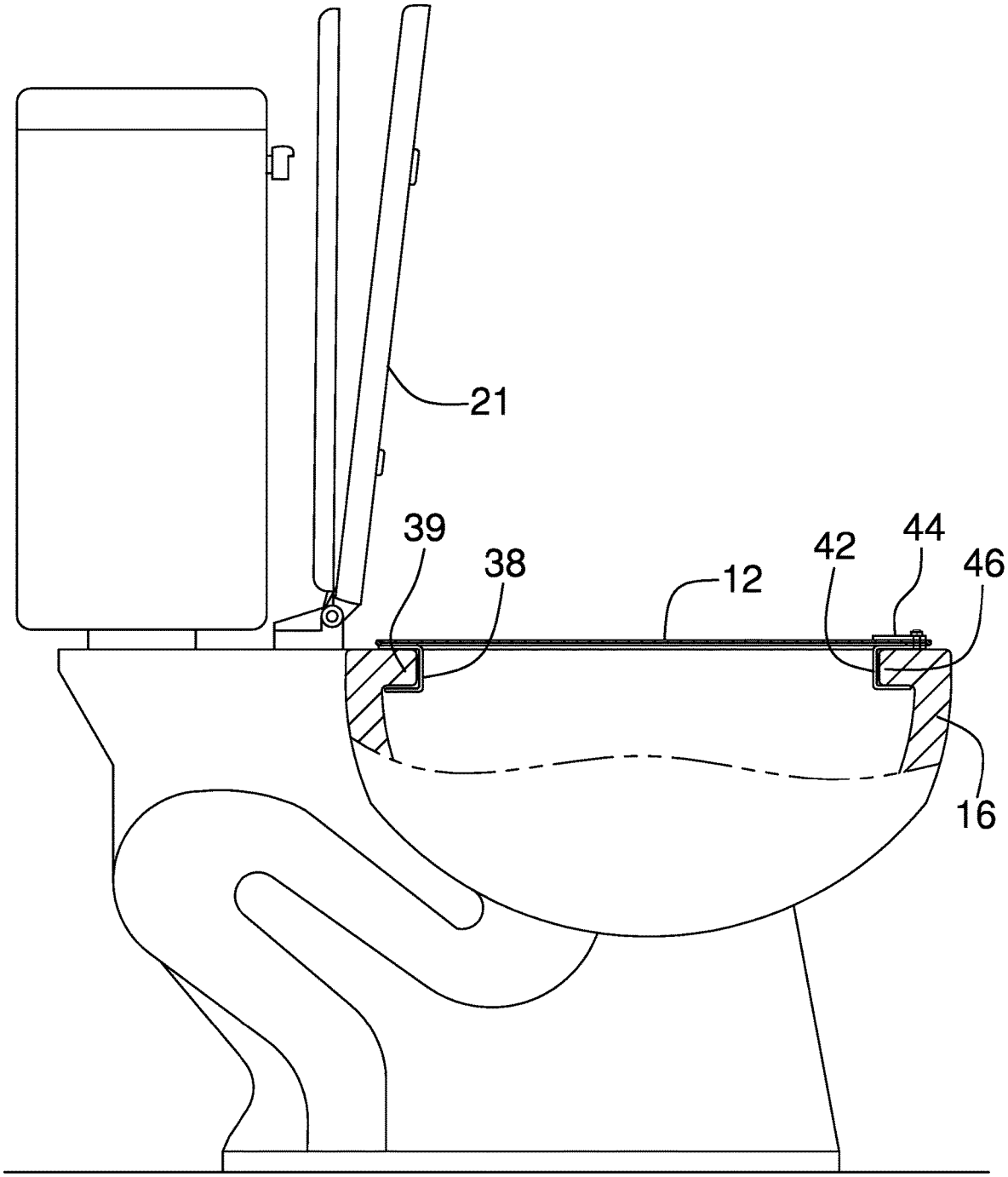
FIG. 5 is a cross-sectional in-use view of an embodiment of the disclosure.
Figure 6:
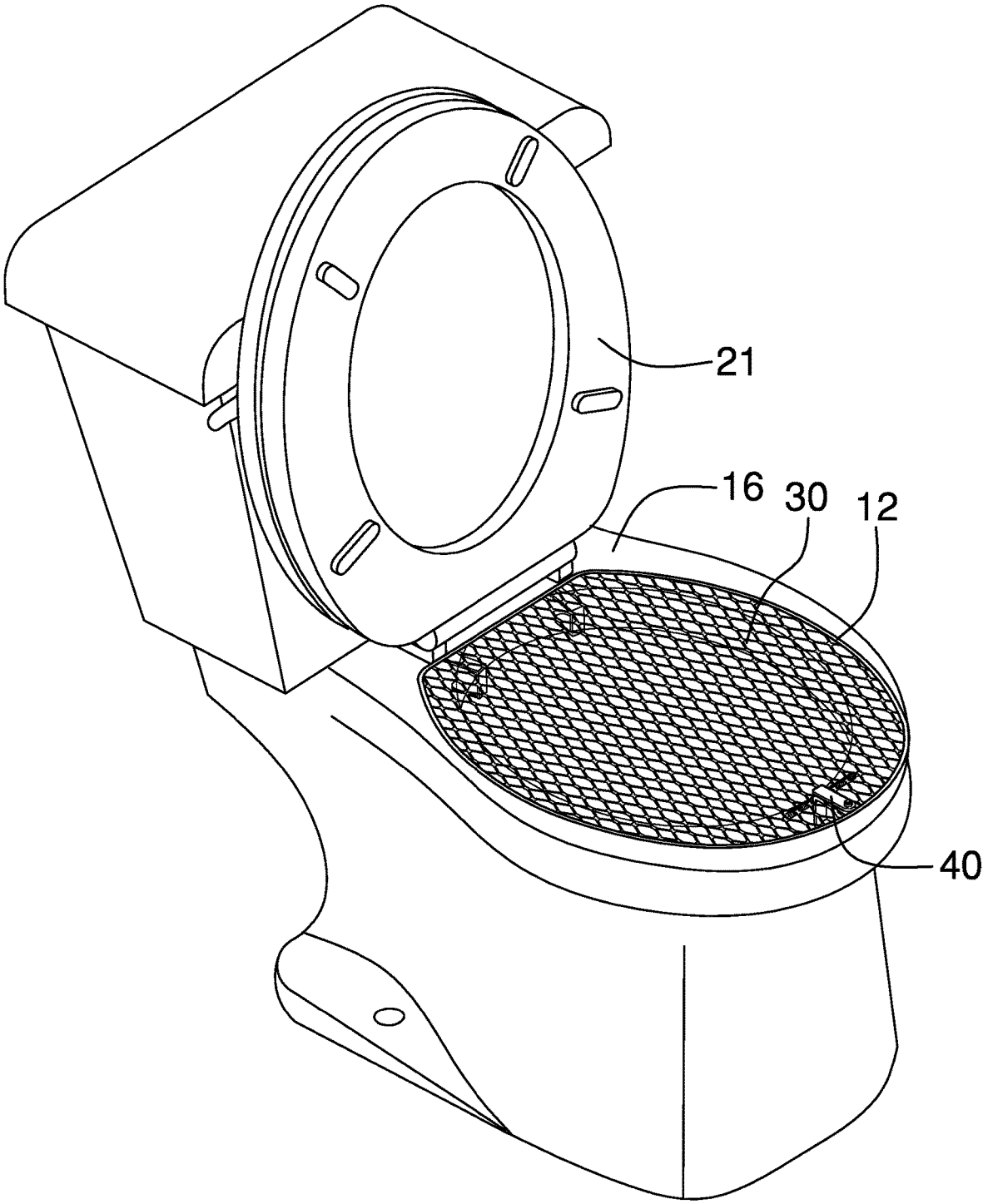
FIG. 6 is an isometric in-use view of an embodiment of the disclosure.

With reference now to the drawings, and in particular to FIGS. 1 through 6 thereof, a new toilet bowl screen device embodying the principles and concepts of an embodiment of the disclosure and generally designated by the reference numeral 10 will be described.

As best illustrated in FIGS. 1 through 6, the toilet bowl screen apparatus 10 generally comprises a screen edge 12 configured to conform to the shape of a rim 14 of a toilet bowl 16. The screen edge 12 is configured to be larger than an inner perimeter 18 and smaller than an outer perimeter 20 of the rim of the toilet bowl in order to rest on the rim 14 without falling in or being exposed when a seat 21 of the toilet bowl 16 is down. An edge rear portion 22 of the screen edge may be linear. A pivot ear 24 may extend from an apex 26 of an edge front portion 28 of the screen edge.

A screen body 30 is coupled to the screen edge 12. The screen body 30 continuously covers within the screen edge 12. The screen body 30 is mesh and has a plurality of gaps 32. Each gap 32 is configured to be small enough to prevent a snake or other animal from crawling therethrough. Each gap 32 may be a rounded diamond shape. The screen body 30 has a body top side 34 and a body bottom side 36.

A pair of rear clips 38 is coupled to the screen body 30. Each of the rear clips 38 is coupled to the body bottom side 36 and is configured to selectively engage a rim rear portion 39 of the rim of the toilet bowl. Each of the rear clips 38 may be angled relative the edge rear portion 22. A front clip 40 is coupled to the screen edge 12. The front clip 40 has a front hook portion 42 pivotably coupled to the pivot ear 24 of the screen edge and resting below the body bottom side 36. The front clip 40 also has a handle portion 44 coupled to the front hook portion 42 and extending above the body top side 34. Each of the rear clips 38 and the front hook portion 42 of the front clip may be a squared C-shape and has a return portion 46 with a rounded distal end 47. The return portion 46 is configured to rest below an underside 50 of the rim of the toilet bowl with the rounded distal end 47 preventing damage to the toilet bowl 16.

The handle portion 44 allows a user to pivot the front hook portion 42 while the pair of rear clips 38 is engaged with the rim 14. The front hook portion 42 is configured to selectively engage or disengage a rim front portion 46 of the rim of the toilet bowl to secure or release the apparatus 10. A pair of springs 48 may be coupled to the front clip 40 and the screen body 30. Each of the pair of springs 48 is oriented perpendicularly to the front clip 40. The pair of springs 48 returns the front clip to an engaged position oriented orthogonally to the apex 26 of the edge front portion of the screen edge after it has been turned with handle portion 44 and released.

In use, the pair of rear clips 38 is engaged with the rim rear portion 39. The handle portion 44 of the front clip is turned to allow the screen edge 12 to fully rest on the rim 14 of the toilet bowl. The handle portion 44 is then released and the pair of springs 48 returns the front clip 40 to the engaged position such that the front hook portion 42 engages the rim front portion 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet bowl screen apparatus comprising:

a screen edge, the screen edge being configured to conform to the shape of a rim of a toilet bowl and being larger than an inner perimeter of the rim of the toilet bowl;

a screen body coupled to the screen edge, the screen body continuously covering within the screen edge, the screen body being mesh and having a plurality of gaps, each gap being configured to be small enough to prevent an animal from crawling therethrough, the screen body having a body top side and a body bottom side;

a pair of rear clips coupled to the screen body, each of the rear clips being coupled to the body bottom side and being configured to selectively engage a rim rear portion of the rim of the toilet bowl; and a front clip coupled to the screen edge, the front clip having a front hook portion pivotably coupled to the screen edge and resting below the body bottom side and a handle portion coupled to the front hook portion and extending above the body top side, the handle portion allowing a user to move the front hook portion with the front hook portion being configured to selectively engage or disengage a rim front portion of the rim of the toilet bowl.

2. The toilet bowl screen apparatus of claim 1 further comprising each of the rear clips and the front hook portion of the front clip being a squared C-shape and having a return portion with a rounded distal end, the return portion being configured to rest below an underside of the rim of the toilet bowl.

3. The toilet bowl screen apparatus of claim 1 further comprising an edge rear portion of the screen edge being linear.

4. The toilet bowl screen apparatus of claim 3 further comprising each of the rear clips being angled relative the edge rear portion.

5. The toilet bowl screen apparatus of claim 1 further comprising the screen edge being configured to be smaller than an outer perimeter of the rim of the toilet bowl.

6. The toilet bowl screen apparatus of claim 1 further comprising a pair of springs coupled to the front clip and the screen body, the pair of springs returning the front clip to an engaged position oriented orthogonally to an apex of an edge front portion of the screen edge.

7. The toilet bowl screen apparatus of claim 6 further comprising each of the pair of springs being oriented perpendicularly to the front clip.

8. The toilet bowl screen apparatus of claim 1 further comprising the front clip being pivotably coupled to a pivot ear of the screen edge extending from an apex of an edge front portion of the screen edge.

9. A toilet bowl screen apparatus comprising:

a screen edge, the screen edge being configured to conform to the shape of a rim of a toilet bowl and being larger than an inner perimeter and smaller than an outer perimeter of the rim of the toilet bowl, an edge rear portion of the screen edge being linear, a pivot ear extending from an apex of an edge front portion of the screen edge;

a screen body coupled to the screen edge, the screen body continuously covering within the screen edge, the screen body being mesh and having a plurality of gaps, each gap being configured to be small enough to prevent a snake or other animal from crawling therethrough, the screen body having a body top side and a body bottom side;

a pair of rear clips coupled to the screen body, each of the rear clips being coupled to the body bottom side and being configured to selectively engage a rim rear portion of the rim of the toilet bowl, each of the rear clips being angled relative the edge rear portion;

a front clip coupled to the screen edge, the front clip having a front hook portion pivotably coupled to the pivot ear of the screen edge and resting below the body bottom side and a handle portion coupled to the front hook portion and extending above the body top side, each of the rear clips and the front hook portion of the front clip being a squared C-shape and having a return portion with a rounded distal end, the return portion being configured to rest below an underside of the rim of the toilet bowl, the handle portion allowing a user to move the front hook portion with the front hook portion being configured to selectively engage or disengage a rim front portion of the rim of the toilet bowl; and a pair of springs coupled to the front clip and the screen body, each of the pair of springs being oriented perpendicularly to the front clip, the pair of springs returning the front clip to an engaged position oriented orthogonally to the apex of the edge front portion of the screen edge.

10. A combination toilet and toilet bowl screen apparatus comprising:

a toilet, the toilet having a toilet bowl;

a screen edge, the screen edge conforming to the shape of a rim of the toilet bowl and being larger than an inner perimeter and smaller than an outer perimeter of the rim of the toilet bowl, an edge rear portion of the screen edge being linear, a pivot ear extending from an apex of an edge front portion of the screen edge;

a screen body coupled to the screen edge, the screen body continuously covering within the screen edge, the screen body being mesh and having a plurality of gaps, each gap being configured to be small enough to prevent a snake or other animal from crawling therethrough, the screen body having a body top side and a body bottom side;

a pair of rear clips coupled to the screen body, each of the rear clips being coupled to the body bottom side and selectively engaging a rim rear portion of the rim of the toilet bowl, each of the rear clips being angled relative the edge rear portion;

a front clip coupled to the screen edge, the front clip having a front hook portion pivotably coupled to the pivot ear of the screen edge and resting below the body bottom side and a handle portion coupled to the front hook portion and extending above the body top side, each of the rear clips and the front hook portion of the front clip being a squared C-shape and having a return portion with a rounded distal end, the return portion resting below an underside of the rim of the toilet bowl, the handle portion allowing a user to move the front hook portion with the front hook portion to selectively engage or disengage a rim front portion of the rim of the toilet bowl; and a pair of springs coupled to the front clip and the screen body, each of the pair of springs being oriented perpendicularly to the front clip, the pair of springs returning the front clip to an engaged position oriented orthogonally to the apex of the edge front portion of the screen edge.

* * * * *